US006116475A

United States Patent [19]

Delage

[11] Patent Number: 6,116,475

[45] Date of Patent: Sep. 12, 2000

[54] DISPENSING HEAD AND PACKAGING AND DISPENSING ASSEMBLY EQUIPPED WITH SUCH A HEAD

[75] Inventor: Jean-Francois Delage, Clamart, France

[73] Assignee: L'Oreal, Paris, France

[21] Appl. No.: 09/163,010

[22] Filed: Sep. 30, 1998

[30] Foreign Application Priority Data

Sep. 30, 1997 [FR] France ..... 97 12137

[51] Int. Cl.[7] ..... B65D 25/40

[52] U.S. Cl. ..... 222/494; 222/402.12; 239/DIG. 12

[58] Field of Search ..... 222/494, 321.7, 222/380, 402.12; 239/533.13, DIG. 12

[56] References Cited

U.S. PATENT DOCUMENTS 3,365,138 1/1968 Green .
4,820,052 4/1989 Krysel ..... 239/533.13 X

FOREIGN PATENT DOCUMENTS 0 410 858 A2 1/1991 European Pat. Off. .
0 673 852 A1 9/1995 European Pat. Off. .

*Primary Examiner*—Charles E. Phillips
*Attorney, Agent, or Firm*—Oblon, Spivak, McClelland, Maier & Neustadt, P.C.

[57] ABSTRACT

A dispensing head for a container holding a product of liquid-to-pasty consistency includes a body in which a product outlet orifice and a closure member for selectively closing off the orifice are provided. The closure member includes of a member made of an elastically deformable material covering the orifice and is configured to move away under the pressure of the product in order to expose the orifice and allow the product to pass through it, and is configured to return to the closed position when the pressure is released. The closure member includes a sleeve, a first end of which is fastened to the body and a second end of which forms a free edge, said sleeve surrounds the body and is positioned over the orifice when said free edge has been turned up over the body. The body is rigid or semi-rigid.

19 Claims, 3 Drawing Sheets

DISPENSING HEAD AND PACKAGING AND DISPENSING ASSEMBLY EQUIPPED WITH SUCH A HEAD

BACKGROUND OF THE INVENTION

1. Field of the Invention

The present invention relates to a dispensing head for a container holding a product of liquid-to-pasty consistency, especially a cosmetic or pharmaceutical product.

2. Description of the Related Art

U.S. Pat. No. 4,099,651 describes a dispensing head comprising a tubular element fixed to the neck of a flexible tube. The tubular element has, over at least part of its length, a plane partition which extends beyond the tubular element so as to define two output channels for the product. A sleeve made of elastic material is slipped over the tubular element and over that part of the plane partition which extends beyond it. The closure system consists of the edge of the sleeve of elastic material which rests on the two opposite faces of the end of the plane partition. This edge is in contact with the partition when no product is being dispensed and moves away from the partition under the pressure of the product. Because of its elasticity, the edge comes back into contact with the faces when the dispensing operation stops.

In such a closure system, the contact between the edge of the sleeve and the partition is provided only by the elasticity of the edge region of the sleeve and this results in very insufficient sealing at rest, in particular when the dispensed product is very viscous.

U.S. Pat. No. 4,124,150 discloses a dispensing assembly comprising a closure in the form of an elastically deformable member subjected to the action of a biasing member which tends to keep this closure applied against a seat with which it engages in order to ensure that the contact is sealed upon closure. The biasing member is formed by a kind of leaf spring which projects to the outside and is relatively bulky. Furthermore, such a system is composed of a number of pieces, incompatible with the economic constraints of the industrial environment.

European Patent Application EP 0,410,858 describes a device of the same type in which the closure means is subjected to the action of a rigid biasing member.

Most of these known devices, apart from the specific problems discussed above, require fitting operations which substantially affect the cost of the dispensing head.

U.S. Pat. No. 3,365,138 describes a dispensing head formed by an element made as a single piece, a first portion of which defines a chamber having orifices and a second portion of which is intended to be turned up over the first portion so as to close off the holes selectively. The two portions are formed from the same elastically deformable material, so as to allow it to be turned up, as mentioned above. Thus, there is an elastically deformable element which is bent back over a "body" which is also elastically deformable.

One of the problems associated with the design of the device described in that document stems from the fact that, upon opening, it exhibits a substantial inertia. Furthermore, making orifices in an elastically deformable body is made much more difficult, in particular when holes of small cross-section have to be made. This is because, due to the elastically deformable nature of the material, it is necessary to oversize the orifices, which is contrary to the goal of making small orifices. Finally, because of the relatively low resistance offered by the body, it is not possible to provide a very effective sealed closure.

SUMMARY OF THE INVENTION

One of the objects of the present invention is to provide a dispensing head which includes a closure means which is of the type discussed above and is simple and inexpensive to fit.

A further object of the invention is to provide a dispensing head equipped with a closure which provide satisfactory sealing without the need for an auxiliary stressing member.

Further objects of the invention will appear in detail in the description which follows.

According to a first aspect of the invention, these and other objects are achieved by producing a dispensing head for a container holding a product of liquid-to-pasty consistency, comprising a body in which a product outlet orifice and a closure member for selectively closing off the orifice are provided. The closure member includes a member made of elastically deformable material covering the orifice and is configured to move away under the pressure of the product in order to expose the orifice and allow the product to pass through it, and to return to the closed position when the pressure is released. The closure member consists of a sleeve, a first end of which is fastened to the body and a second end of which forms a free edge. The sleeve also fits around the body and is positioned over the orifice by the free edge being turned up over the body, wherein the body is made of a rigid or semi-rigid material.

Thus, the configuration of the closure i.e., an elastic member bent back over a rigid or semi-rigid body, contributes to self-stressing the elastic member, in particular its free edge, over the body of the dispensing head so that no other auxiliary stressing or holding member is required in order to ensure satisfactory sealing. The elastic member may be fitted directly onto the body, or may be fitted onto a mounting piece which is fitted onto the body of the dispensing head. By constructing the body of a rigid or semi-rigid material, i.e. forming a structure which is not multidirectionally deformable in extension, compression or torsion such as an elastomer or equivalent, it is possible to ensure that the elastically deformable sleeve is correctly positioned all around the body. As a result, the aesthetic appearance is improved and the inertia, upon opening and closing, is low. Furthermore, it is possible to size the holes exactly as desired, since the rigid or semi-rigid body does not suffer from the problems associated with forming small orifices in elastically deformable material.

According to a preferred embodiment, the dispensing head is formed by two-shot injection moulding, overmoulding or injection overmoulding of a rigid or semi-rigid first material forming the body and of an elastically deformable material forming the closure member. Thus, the head, including the closure, is produced in a single moulding operation. After molding, all that is necessary is to turn up the free edge of the sleeve over the rigid or semi-rigid body. Thereafter, the dispensing head is ready to be fitted onto a container and used for dispensing the product that it contains.

Preferably, the elastically deformable material is a natural, synthetic or thermoplastic elastomer chosen from styrene-butadiene copolymers, nitrile rubbers, polychloroprene or neoprene, EPDM rubber, polyurethanes, silicone rubber, ethylene-vinyl acetate copolymers, etc. The body itself is made of polypropylene or polyethylene.

According to a particularly advantageous embodiment, the dispensing head consists of a cylindrical body comprising a lateral skirt, an open end of which forms a free edge.

The closure member includes a sleeve placed, before it is turned up, approximately in the extension of the lateral skirt, where the first end of the sleeve being placed inside the lateral skirt, near the free edge of the lateral skirt. Thus, when the sleeve is in the bent-back position, it covers the free edge of the body. This arrangement, when the head is fitted onto a container, provides sealing at this point which completes the overall sealing. Furthermore, the sleeve, by bearing on the free edge of the lateral skirt of the body, is positioned perfectly with respect to the body.

Advantageously, the body is formed by a lateral skirt, a portion of which is covered by the turned-up part of the closure member, wherein the same portion is set back from the rest of the lateral skirt so that, when the closure member is in the turned-up position, the closure member lies in the extension of the rest of the lateral skirt. This improves the aesthetic appearance of the dispensing head.

The walls of the sleeve may have a thickness of from 0.5 mm to 5 mm, and preferably from 1 mm to 3 mm.

Advantageously, the free edge of the sleeve has an extrusion forming a lip which, after the free edge has been turned up, is placed opposite the orifice. This extrusion forming a lip allows better localization of the output of the product.

In the closed-off position, the closure member can close off the orifice in a sealed manner. Additionally, in the closure position, the elastic member bears on a rigid seat formed by the body all around the outlet orifice(s).

According to a variant, in the closed position, the closure member allows air to be taken up into the container.

The dispensing head may comprise housing means for housing for an open neck of a container having deformable walls (for example, a tube). Such housing means may include a thread or a snap-fit flange.

Alternatively, the dispensing head comprises housing means for housing a stem of a pump or valve, which sits on top of a pump or valve provided on the container, a passage communicating the stem of the pump or valve with the outlet orifice and a bearing surface for actuation of the pump or valve provided on the body. In the case of a pump or a penetration-type valve, the bearing surface is located opposite the open end of the body. In the case of a swing-type valve, the bearing surface consists of a lateral portion of the body of the head.

A second aspect the invention also provides a packaging and dispensing assembly for a product of liquid-to-pasty consistency, comprising a container holding the product and a dispensing head, wherein the dispensing head is in accordance with the first aspect of the invention.

According to a first embodiment, the container comprises walls which can be deformed in order to cause the expulsion, under pressure, of the product by pressing on the flexible walls.

According to a second embodiment, the product is packaged under pressure in the container, wherein the container is surmounted by a valve whose operation is controlled by the dispensing head.

According to a third embodiment, the product is pressurized by means of a manually operated pump sitting on top of the container, wherein the operation of the pump is controlled by the dispensing head. Advantageously, the container consists of a flexible pouch contained inside a rigid or semi-rigid enclosure.

The product may be a cosmetic or pharmaceutical product in the form of milk, gel, cream, especially moisturizer, sunscreen, make-up product or a beauty care product.

BRIEF DESCRIPTION OF THE DRAWINGS

The invention consists, apart from the arrangements explained above, of a certain number of other arrangements which will be detailed below, with regard to non-limiting illustrative embodiments described with reference to the appended Figures among which.

DETAILED DESCRIPTION OF THE PREFERRED EMBODIMENTS

Figure 1A:
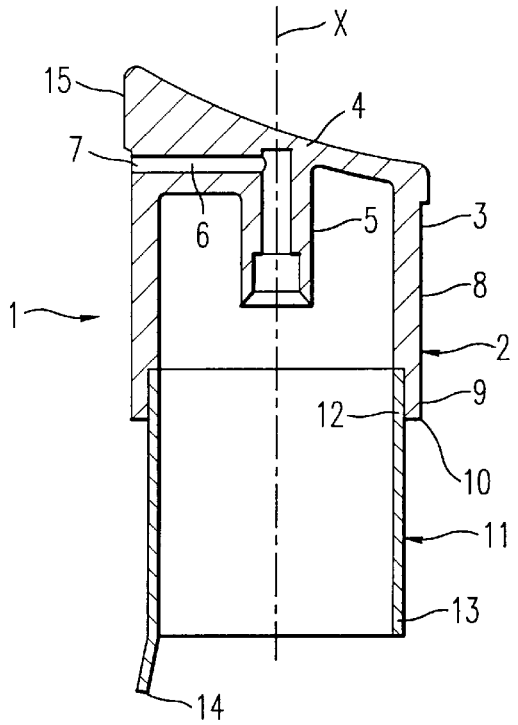
FIGS. 1A is a sectional view of an embodiment of a dispensing head in accordance with the invention, illustrating a position of the sleeve before it is turned up.
Figure 1B:
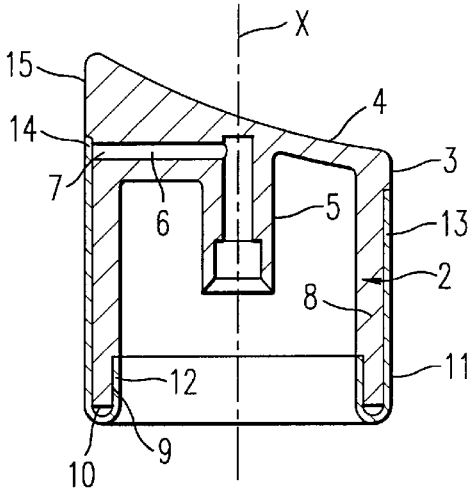
FIG. 1B is a sectional view of an embodiment shown in FIG. 1, illustrating a turned up position of the sleeve.

In the embodiment shown in FIGS. 1A–1D, the dispensing head 1 is made in the form of a push-button configured to fit onto a stem of a valve or pump. The push-button has a rigid cylindrical body 2 aligned with axis X as shown in the figure. Body 2 is formed by a lateral skirt 8, a first end 3 of which is closed by a slightly inclined wall 4, which forms a bearing surface for actuating a valve or pump. The body 2 has a central duct 5, the cross-section of which is sized to allow the push-button to be force-fitted onto a stem of a valve or pump. The central duct 5 defines an axial passage communicating with a passage 6 lying approximately at right angles to the axial passage of duct 5. The passage 6 also communicates with an outlet orifice 7 made in the upper part of the lateral skirt 8 of the body 2. The lateral skirt 8 has, at its end 9 opposite the bearing surface 4, a free edge 10.

The push-button also includes a sleeve 11 made of elastomeric material, one end 12 of which is fastened to the inside surface of the end 9 of the lateral skirt 8. Although the sleeve 11 is preferably fitted inside the body 2, the connection between the body and the sleeve 11 may be in a region other than that illustrated in this embodiment.

According to a preferred embodiment, the sleeve 11 and the body 2 are produced by two-shot injection moulding or injection overmoulding of two compatible materials capable of forming physico-chemical bonds by melting. By way of example, the body is made of polypropylene or polyethylene. The sleeve 11 is formed from an elastomeric material such as an ethylene-propylene-diene copolymer (EPDM). The internal surface of the lateral wall 8 forms, in the region of connection between the body 2 and the sleeve 11, a slight step or ridge so that the sleeve does not result in extra thickness compared with the internal surface of the lateral wall 8. Typically, the thickness of the wall of the sleeve 11 is about 1 mm to 2 mm.

Figure 1C:
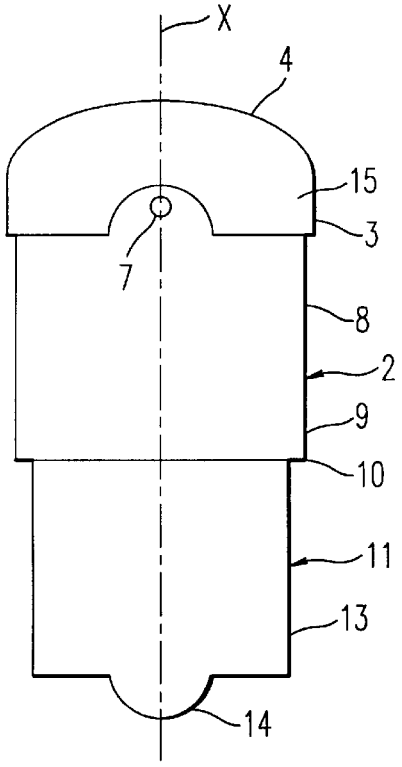
FIG. 1C is a side elevational view of the dispensing head with the sleeve position shown in FIG. 1A.
Figure 1D:
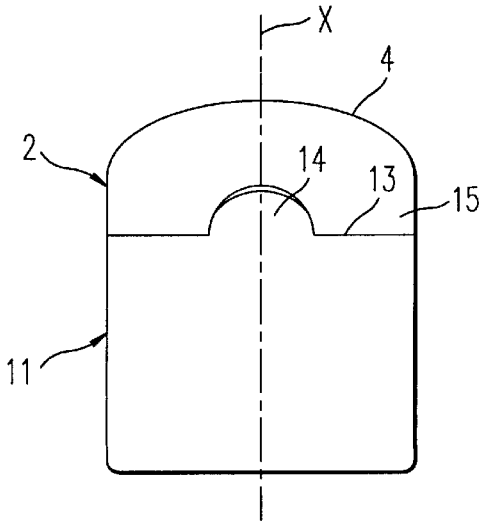
FIG. 1D is a side elevational view of the dispensing head with the sleeve position shown in FIG. 1B.

The sleeve 11, as moulded, lies approximately in the extension of the internal surface of the lateral skirt 8 (see FIGS. 1A and 1C). The sleeve 11 has a free edge 13, and includes an extrusion portion which forms a lip 14. When the sleeve 11 is bent back over the body 2, in the manner of a "sock" (see FIGS. 1B and 1D), lip 14 covers the orifice 7 so as to close it off. In the embodiment illustrated, the lip is designed in such a way that, in the closed position, it bears against a rigid part of the body surrounding the orifice 7.

As may be clearly seen in FIGS. 1A–1D, the body 2 of the dispensing head 1 has, near the bearing surface 4, a cross-section which is slightly larger than the cross-section of the rest of the lateral skirt 8. Provided as such, when the sleeve 11 is in the position in which it is turned up over the body 2, the sleeve is approximately along the extension of the lateral edge 15 of the bearing surface 4.

In order to produce the dispensing head according to the invention, the body 2 is firstly moulded. Next, the sleeve 11 is overmoulded or injection overmoulded. After demoulding, the sleeve 11 is turned up, manually or in a mechanized manner, over the body 2 so that the lip 14 closes off the orifice 7. The dispensing head is then ready to be fitted onto a container equipped with a valve or pump, or onto a tube or other container with deformable walls. It is obvious that other means could be used for fastening the sleeve 11 of the body 2. By way of example, this operation could be carried out by adhesive bonding or by welding.

Figure 2A:
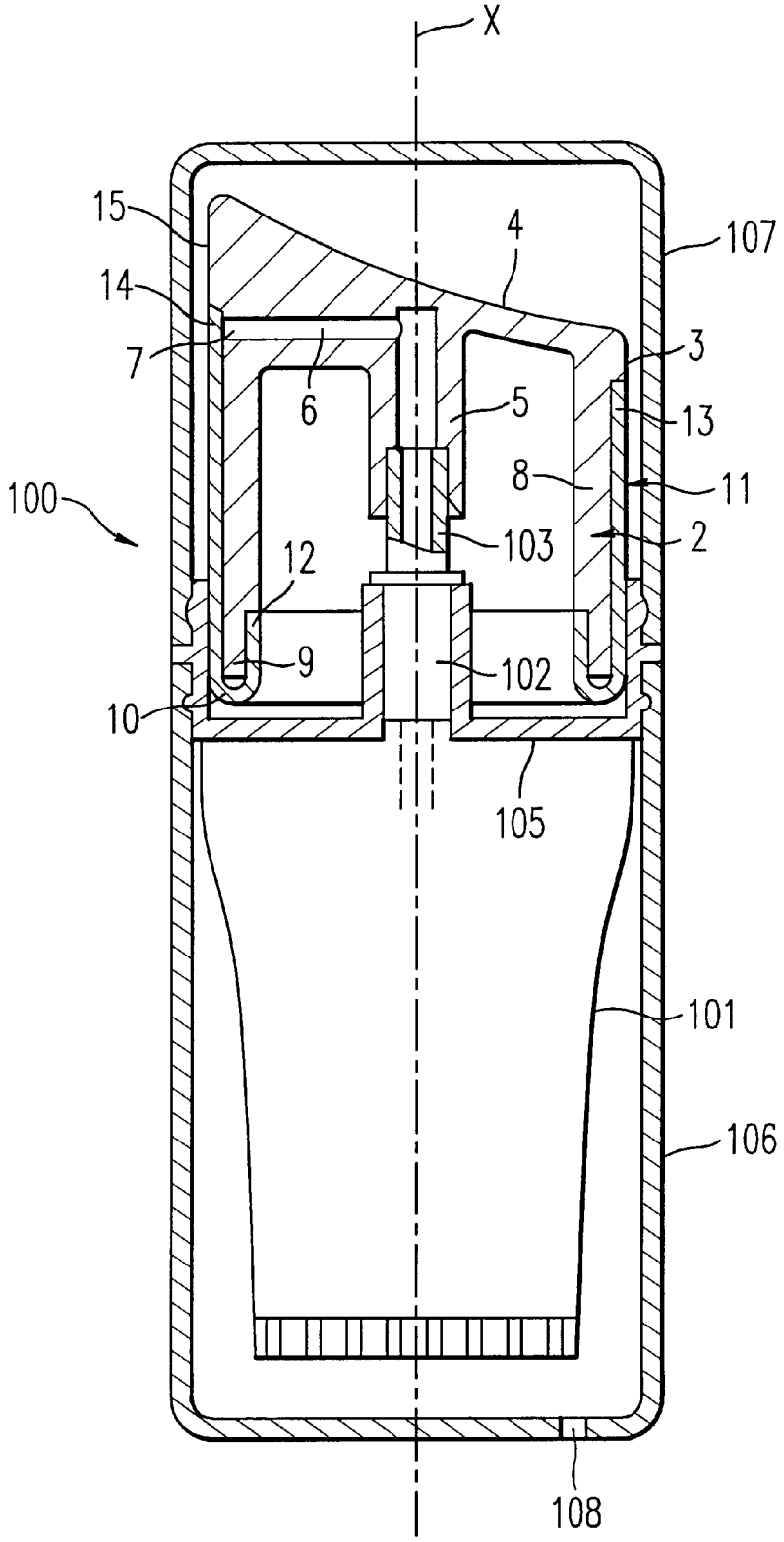
FIG. 2A is a sectional view of a second embodiment of the packaging and dispensing assembly according to a further aspect of the present invention.

FIG. 2A illustrates a packaging and dispensing assembly 100 equipped with a dispensing head such as that described with reference to FIGS. 1A–1D. Typically, this assembly 100 has a container 101 in the form of a pouch made of flexible material, surmounted by a rigid pouch head 105 onto which a pump 102 is fixedly fitted (for example by crimping). The pouch is contained inside a rigid or semi-rigid enclosure 106 which includes, at its bottom, an air uptake orifice 108. The pump 102 includes a hollow emergent stem 103 onto which the axial duct 5 of the push-button is forcibly fitted. A cap 107 is provided for protecting the dispensing head in the storage position.

Figure 2B:
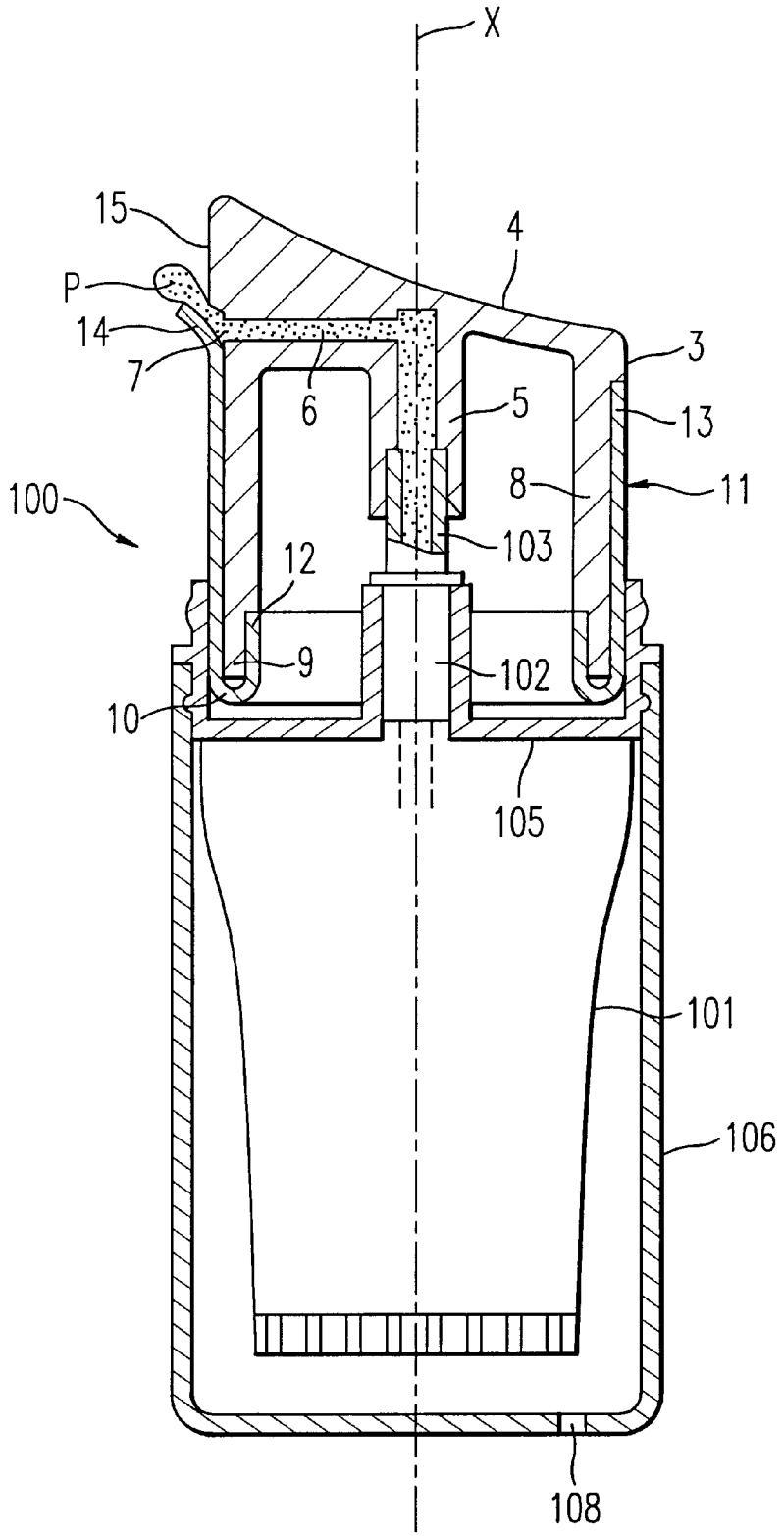
FIG. 2B is a sectional view of a the packaging and dispensing assembly shown in FIG. 2A, illustrating the ejection of product from the dispensing head.

In order to dispense a metered quantity of product held in the container 101, the user exerts pressure on the bearing surface 4, which causes the pump stem 103 to be pushed in and, after the pump body has been filled, expels the product under pressure. The product P emerges from the stem 103, passes along the axial duct 5 and the radial passage 6 and exits the device through the orifice 7 by moving away the free edge of the lip 14. This dispensing position is illustrated in FIG. 2B. When the pressure on the product is released, the lip 14 returns to the closed position against that part of the body bounding the orifice 7.

In the foregoing detailed description, reference was made to preferred embodiments of the invention. It is obvious that variants may be made thereto without departing from the scope of the invention as claimed hereinafter.

What is claimed as new and desired to be secured by Letters Patent of the United States is:

1. A dispensing head for a container holding a product of liquid-to-pasty consistency, said dispensing head comprising:

any one of a rigid body and a semi-rigid body formed of any one of a rigid first material and a semi-rigid first material wherein any one of said rigid body and said semi-rigid body includes a product outlet orifice;

a closure member selectively moveable between an open position and a closed position for opening and closing said orifice, said closure member comprising an elastically deformable member formed of an elastically deformable second material and covering said orifice, said elastically deformable member configured to move away from said orifice under pressure of the product to said open position in order to expose said orifice and allow the product to pass through said orifice, said elastically deformable member configured to return to said closed position when the pressure is released;

wherein said closure member comprises a sleeve, said sleeve having a first end fastened to said body and a second end forming a free edge, said sleeve substantially surrounding said body and being positioned over said orifice when said free edge has been turned up over said body; and wherein said dispensing head is formed by at least one of two-shot injection molding, overmolding and injection overmolding of any one of said rigid first material and said semi-rigid first material forming said body and of said elastically deformable second material forming said closure member.

2. The dispensing head according to claim 1, wherein said elastically deformable second material is at least one of a styrene-butadiene copolymers, nitrile rubbers, polychloroprene or neoprene, EPDM rubber, polyurethanes, silicone rubber, and ethylene-vinyl acetate copolymers.

3. The dispersing head according to claim 2, wherein said body comprises a lateral skirt with an open end which forms a free edge, and wherein said sleeve is provided, before it is turned up, approximately in an extension of said lateral skirt, said first end of said sleeve being placed inside said lateral skirt near said free edge of said lateral skirt.

4. The dispensing head according to claim 1, wherein said body comprises a lateral skirt with an open end which forms a free edge, and wherein said sleeve is provided, before it is turned up, approximately in an extension of said lateral skirt, said first end of said sleeve being placed inside said lateral skirt near said free edge of said lateral skirt.

5. The dispensing head according to claim 4, wherein a portion of said lateral skirt is covered by a turned-up part of said closure member, said portion being recessed from a first part of said lateral skirt such that, when said closure member has been turned up over said body, said closure member lies in said extension of said first part of said lateral skirt.

6. The dispensing head according to claim 4, wherein walls of said sleeve have a thickness of from 0.5 mm to 5 mm.

7. The dispensing head according to claim 4, wherein said free edge of said sleeve has an extrusion forming a lip which, after said free edge has been turned up, is placed opposite said orifice.

8. The dispersing head according to claim 4, wherein walls of said sleeve have a thickness of from 1 mm to 3 mm.

9. The dispensing head according to claim 1, wherein said closure member allows air to be taken up into a container when said closure member is in said closed position.

10. The dispensing head according to claim 1, further comprising means for housing an open neck of a container having deformable walls.

11. The dispensing head according to claim 1, further comprising:

means for housing a stem of a pump or valve, which sits on top of a pump or valve provided on a container;

a passage communicating between a stem of the pump or valve and said outlet orifice;

wherein said body includes a bearing surface for actuation of the pump or valve.

12. The dispensing head according to claim 1, wherein said closure member closes said orifice in a sealed manner when said closure member is in said closed position.

13. A packaging and dispensing assembly for a product of liquid-to-pasty consistency, comprising:

a container for holding the product; and a dispensing head comprising:

any one of a rigid body and a semi-rigid body formed of any one of a rigid first material and a semi-rigid first material and including a product outlet orifice;

a closure member selectively moveable between an open position and a closed position for opening and closing said orifice, said closure member comprising an elastically deformable member formed of a elastically deformable second material and covering said orifice, said elastically deformable member configured to move away from said orifice under pressure of the product to said open position in order to expose said orifice and allow the product to pass through said orifice, said elastically deformable member configured to return to said closed position when the pressure is released;

wherein said closure member consists of a sleeve, said sleeve having a first end fastened to said body and a second end forming a free edge, said sleeve substantially surrounding said body and being positioned over said orifice when said free edge has been turned up over said body; and wherein said dispensing head is formed by at least one of two-shot injection molding, overmolding and injection overmolding of any one of said rigid first material and said semi-rigid first material forming said body and of said elastically deformable second material forming said closure member.

14. The packaging and dispensing assembly according to claim 13, wherein the product is packaged under pressure in said container, said container including a valve, operation of which is controlled by said dispensing head.

15. The packaging and dispensing assembly according to claim 13, further comprising a manually operated pump provided on top of said container, said manually operated pump configured to pressurize the product wherein operation of said manually operated pump is controlled by said dispensing head.

16. The packaging and dispensing assembly according to claim 15, wherein said container comprises a flexible pouch contained inside at least one of a rigid or semi-rigid enclosure.

17. The packaging and dispensing assembly according to claim 13, wherein the product is at least one of a cosmetic or pharmaceutical product.

18. The packaging and dispensing assembly according to claim 13, wherein said container comprises walls configured to be deformed in order to cause the expulsion, under pressure, of the product by pressing on said walls.

19. A dispensing head for a container holding a product of liquid-to-pasty consistency, said dispensing head comprising:

any one of a rigid body and a semi-rigid body formed of any one of a rigid first material and a semi-rigid first material wherein any one of said rigid body and said semi-rigid body includes a product outlet orifice;

a closure member selectively moveable between an open position and a closed position for opening and closing said orifice, said closure member comprising an elastically deformable member formed of an elastically deformable second material and covering said orifice, said elastically deformable member configured to move away from said orifice under pressure of the product to said open position in order to expose said orifice and allow the product to pass through said orifice, said elastically deformable member configured to return to said closed position when the pressure is released;

wherein said closure member comprises a sleeve, said sleeve having a first end fastened to said body and a second end forming a free edge, said sleeve substantially surrounding said body and being positioned over said orifice when said free edge has been turned up over said body; and wherein said body comprises a lateral skirt with an open end which forms a free edge, and wherein said sleeve forms approximately, before being turned up, an extension of said lateral skirt, said first end of said sleeve being placed inside said lateral skirt has been inserted.

* * * * *